United States Patent [19]

Asahi et al.

[11] Patent Number: 4,723,723

[45] Date of Patent: Feb. 9, 1988

[54] CASE FOR SURFACE-TYPE FASTENER

[75] Inventors: Sadaho Asahi, Uozu; Yasuo Yamada, Kurobe; Hiroo Minami, Uozu, all of Japan

[73] Assignee: Yoshida Kogyo, K.K., Tokyo, Japan

[21] Appl. No.: 31,127

[22] Filed: Mar. 30, 1987

[30] Foreign Application Priority Data

Apr. 8, 1986 [JP] Japan ..... 61-52287[U]
Jun. 14, 1986 [JP] Japan ..... 61-90918

[51] Int. Cl.[4] ..... B65H 16/00; B65D 85/672

[52] U.S. Cl. ..... 242/55.53; 242/76; 206/338; 206/394; 206/348; 206/409

[58] Field of Search ..... 242/76, 55.53, 55.2; 206/338, 390, 391, 394, 404, 348, 389, 409

[56] References Cited

U.S. PATENT DOCUMENTS

| | | | |
|---|---|---|---|
| 1,161,533 | 11/1915 | Schloss | 242/55.53 |
| 2,237,920 | 4/1941 | Armitt | 242/55.53 |
| 2,298,530 | 1/1967 | Clouthier | 206/391 X |
| 2,782,029 | 2/1957 | Uritis | 242/76 |
| 3,709,445 | 1/1973 | Adams | 242/55.2 |
| 3,823,894 | 7/1974 | Frederick et al. | 206/409 X |
| 4,546,879 | 10/1985 | Viscallas | 206/391 |

FOREIGN PATENT DOCUMENTS

| | | | |
|---|---|---|---|
| 2415595 | 1/1978 | France . | |
| 989872 | 4/1965 | United Kingdom | 206/391 |

*Primary Examiner*—Stephen Marcus
*Assistant Examiner*—T. Graveline
*Attorney, Agent, or Firm*—Hill, Van Santen, Steadman & Simpson

[57] ABSTRACT

Male and female surface-type fastener tapes are unwound from respective spools in a housing and drawn out of the housing through a tape guide swingably disposed in a slot defined in a side panel of the housing. The spools are disconnected from the housing and can easily be replaced with new ones simply by opening a cover of the housing. The tape guide is automatically directed toward the position where the tapes are unreeled off the respective spools. Therefore, the tapes are properly and smoothly mated together by the tape guide as they are progressively passed through the tape guide.

7 Claims, 7 Drawing Figures

CASE FOR SURFACE-TYPE FASTENER

BACKGROUND OF THE INVENTION

1. Field of the Invention

The present invention relates to a case for storing and dispensing an elongate surface-type fastener, and more particularly to such a case for storing male and female surface-type fastener tapes separately therein and drawing out the tapes in a mating combination as a continuous surface-type fastener which may be cut off for use or sale.

2. Description of the Prior Art

One conventional case for storing and dispensing a surface-type fastener is disclosed in French Patent No. 2415595. The disclosed case has a shaft therein and houses a spool with a male surface-type fastener tape wound thereon and another spool with a female surface-type fastener tape wound thereon. The spools are fitted side by side over the shaft. The male and female surface-type fastener tapes can be unreeled off the respective spools and drawn out of the case through a slot defined in a side wall of the case while the tapes are being mated together as a continuous surface-type fastener.

The shaft which supports the spools is fixedly positioned in the case by removable bushings. Therefore, when the tapes are fully unwound from the spools, it is time-consuming to replace the spools with new spools on which respective tapes are wound. Further, as the length of the tape wound on a spool is reduced, the position where the tape is unreeled off the spool is varied, i.e., shifted radially inwardly toward the center of the spool. Since the slot through which the tape can be withdrawn is open in a fixed direction, the tapes as wound from the spools at such varying position may not be properly brought into mating engagement.

SUMMARY OF THE INVENTION

It is an object of the present invention to provide a case for a surface-type fastener which allows spools to be easily replaced with new spools and also permits male and female surface-type fastener tapes to be drawn in properly mating relationship until they are wholly unreeled off the respective spools.

According to the present invention, there is provided a case for storing and dispensing a surface-type fastener, comprising a housing including a side panel having a slot, a pair of substantially coaxial spools for supporting male and female surface-type fastener tapes, respectively, thereon, the spools being rotatably disposed in the housing and axially disconnected from the housing, and a tape guide swingably supported in the slot by the panel, the tape guide having a guide channel of a cross sectional shape complementary to the cross-sectional shape of the male and female surface-type fastener tapes which are mated together. Since the spools are axially disconnected from the housing, they can easily be replaced with new spools by opening a cover of the housing. The male and female surface-type fastener tapes are unreeled from the respective spools and drawn out of the housing through the tape guide during which time the tapes are mated together. As the tapes are progressively unwound from the spools, the tape guide is automatically swung toward the position where the tapes leave the spools. The tapes are therefore properly mated together smoothly by the tape guide.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
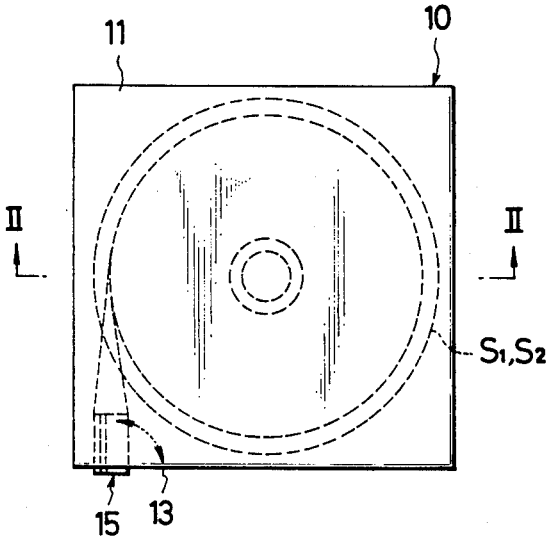
FIG. 1 is a plan view of a case for a surface-type fastener according to the present invention.
Figure 2:
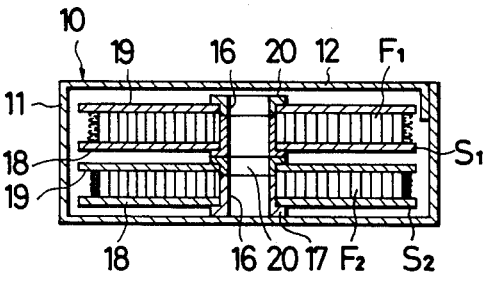
FIG. 2 is a cross-sectional view taken along line II—II of FIG. 1.
Figure 3:
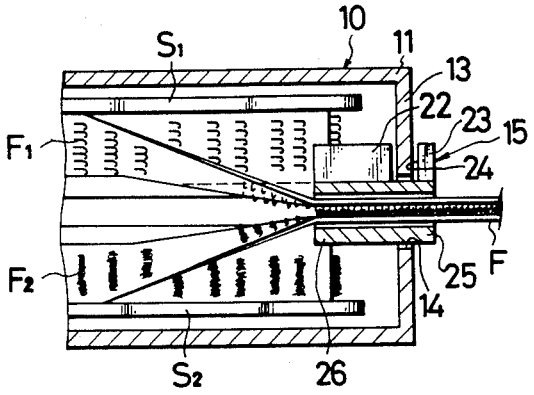
FIG. 3 is an enlarged fragmentary cross-sectional view of the case, showing a slot and a tape guide for drawing out male and female surface-type fastener tapes.

The principles of the present invention are particularly useful when embodied in a case generally designated by the reference numeral 10 in FIGS. 1 through 3.

The case 10 comprises a box-shaped housing 11 which is of a square shape when viewed in plan. The housing 11 is made of cardboard, plastics, metal, or other material and accommodating therein two coaxial spools S1, S2 disposed side by side, the spools S1, S2 being disconnected from the housing 11. Around the spools S1, S2, there are wound male and female surface-type fastener tapes F1, F2, respectively. The male surface-type fastener tape F1 may be a tape with a number of male-type engaging elements such as hooks mounted on one side thereof, and the female surface-type fastener tape F2 may be a tape with a number of female-type engaging elements such as loops mounted on one side thereof. The male and female surface-type fastener tapes F1, F2 can be combined or mated together by engaging the hooks and the loops with each other. The case 10 containing the spools S1, S2 with the tapes F1, F2 wound thereon may be shipped or placed in a retail store for sale.

The housing 11 has an upper cover 12 which is hinged at one edge so as to be freely openable and closable, the upper cover 12 lying substantially perpendicularly to the axes of the spools S1, S2. The spools S1, S2 can easily be put into or removed from the housing 11 while the upper cover 12 is open. The housing 11 also has a side panel 13 with a slot 14 defined therein near one corner of the housing 11. A channel-shaped tape guide 15 is swingably disposed in the slot 14 for drawing therethrough the tapes F1, F2 from the spools S1, S2 while mating the tapes F1, F2 together.

Figure 7:
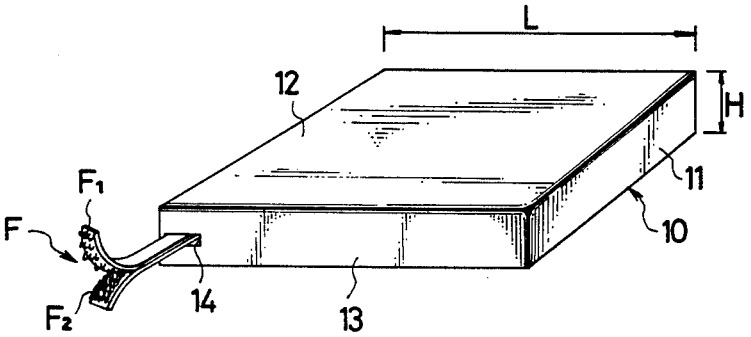
FIG. 7 is a perspective view of the case of the invention.

The housing 11 may vary in size depending on the size of spools to be stored therein. As illustrated in FIG. 7, the length L of one side of the square-shaped housing 11 is slightly larger than the diameter of spools to be housed therein, and the height H of the housing 11 is slightly larger than the sum of the heights of the two spools placed one on the other. Therefore, the spools S1, S2 positioned in the housing 11 can be rotated about their own axes when the respective tapes F1, F2 are unreeled off the spools through the slot 14. The size of the housing 11, the size of the slot 14, and the size of the tape guide 15 therefore vary depending on the size of the spools, the length of the tapes wound on the spools, the size of the tapes on the spools.

Figure 6:
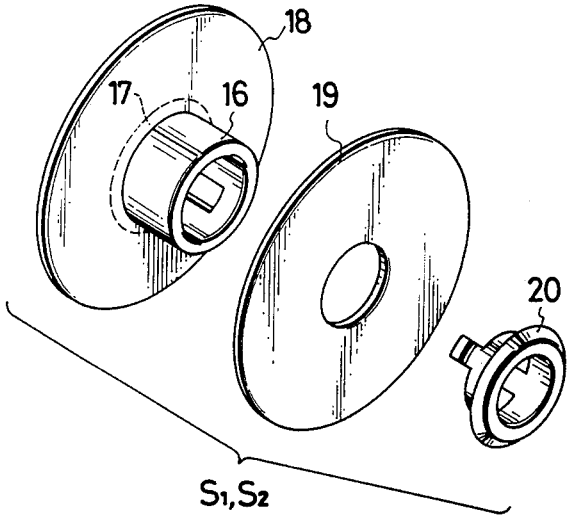
FIG. 6 is an exploded perspective view of a spool.

As shown in FIG. 6, each of the spools S1, S2 stored in the housing 11 comprises a hollow shaft 16 flanged at one end 17 thereof, a pair of flanges or discs 18, 19 mounted on the shaft 16 in axially spaced relation, and a cap 20 snappingly fitted in the other end of the shaft 16, the cap 20 projecting axially from the flange 19. The flange 18 is integral with the hollow shaft 16 while the flange 19 is detachably mounted on the hollow shaft 16. The tapes F1, F2 are wound around the shafts 16, respectively, and retained between the flanges 18, 19. The caps 20 and the flanges 17 serve to allow the spools S1, S2 to rotate smoothly in the housing 11 as shown in FIG. 2.

When all of the tapes F1, F2 are dispensed out of the case 10, the upper cover 12 is opened, and the empty spools S1, S2 are simply removed. Then, new spools with tapes wound thereon are inserted into the housing 11. Therefore, the spools can easily be replaced with new spools in a short period of time.

Figure 4:
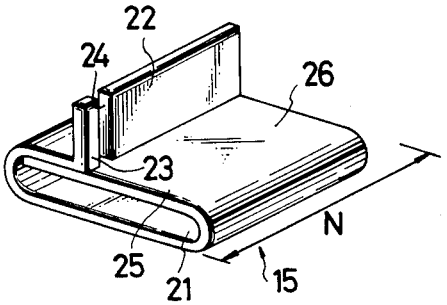
FIG. 4 is an enlarged perspective view of the tape guide shown in FIG. 3.

As shown in FIG. 7, the slot 14 is defined in the side panel 13 substantially centrally in the height H of the housing 11. As illustrated in FIGS. 3 and 4, the tape guide 15 disposed in the slot 14 has a guide channel 21 extending therethrough from end to end, the guide channel 21 being of a cross-sectional shape complementary to the cross-sectional shape of the mated male and female surface-type fastener tapes F1, F2. The guide channel 21 has a prescribed length N such that when the tapes F1, F2 are passed through the guide channel 21 in overlapping relation, their male- and female-type engaging elements engage each other and the tapes F1, F2 are mated together before they emerge from the guide channel 21. The tape guide 15 is made by bending a metal sheet until its ends are overlapped. The overlying end of the metal sheet is bent away from the guide channel 21 into a retainer plate 22 and a locking finger 23 with a recess 24 defined therebetween. In the illustrated embodiment, the retainer plate 22 and the locking finger 23 lie in alignment with each other and are slightly displaced from the center to the lefthand side of the tape guide 15. However, the retainer plate 22 and the locking finger 23 may be disposed centrally in the transverse direction of the tape guide 15.

The tape guide 15 may be placed in the slot 14 in the following manner: The upper cover 12 is open and the tape guide 15 is put into the housing 11 with the locking finger 23 held down against the upper surface of the tape guide 15. Then, a front end 25 of the tape guide 15 where the locking finger 23 is located is inserted into the slot 14 until the front end 25 projects out of the slot 14. The locking finger 23 is now erected to sandwich a portion of the side panel 13 above the slot 14 between the retainer plate 22 and the locking finger 23, i.e., in the recess 24. Since the tape guide 15 in the slot 14 is engaged by the side panel 13 only at the confronting edges of the retainer plate 22 and the locking finger 23, a rear end 26 of the tape guide 15 which is positioned within the housing 11 is freely swingable about the recess 24. The tape guide 15 is therefore allowed to be automatically oriented toward the position where the tapes F1, F2 are progressively unreeled from the respective spools S1, S2 while such position is gradually shifted radially inwardly toward the central axes of the spools S1, S2 as the tapes F1, F2 are dispensed. Such automatic reorientation of the tape guide 15 toward the tape unreeling position is effective in smoothly guiding the tapes F1, F2 into the tape guide 15 and properly mating the tapes F1, F2 within the tape guide 15 at all times until the tapes F1, F2 are fully unwound from the spools S1, S2. The tape guide 15 is prevented from being dislodged from the slot 14 by the retainer plate 22 which engages the inner surface of the side panel 13.

Figure 5:
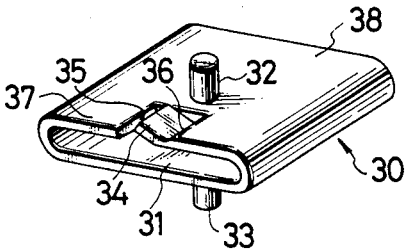
FIG. 5 is an enlarged perspective view of a tape guide according to another embodiment.

FIG. 5 shows a tape guide 30 according to another embodiment of the present invention. The tape guide 30 is of a hollow unitary structure made of synthetic resin such as polypropylene, polyethylene, or the like. The tape guide 30 has a guide channel 31 extending therethrough and a pair of cylindrical coaxial stopper or retainer rods 32, 33 mounted respectively on upper and lower surfaces thereof substantially centrally in the width of the tape guide 30 across the guide channel 31. The tape guide 30 also has a locking finger 34 formed by a recess 35 defined in a front end 37 of the tape guide 30 near the stopper rod 32. The locking finger 34 is inclined upwardly away from the guide channel 31 and has a notch 36 defined in its upper surface in line with the stopper rod 32. The locking finger 34 thus constructed is resiliently deformable toward the guide channel 31 until it lies almost flatwise in the recess 35.

The tape guide 30 can be inserted in the slot 14 by placing the tape guide 30 in the housing 11 and moving the front end 37 of the tape guide 30 into the slot 14 while depressing the locking finger 34 against the resiliency thereof until the front end 37 projects from the slot 14. Then, the locking finger 34 is released to spring back or erect about the notch 36, thereby sandwiching the side panel 13 of the housing 11 between the locking finger 34 and the stopper rod 32. With the tape guide 30 thus positioned in the slot 14, the rear end 38 of the tape guide 30 located in the housing 11 can freely swing about the space between the stopper rod 32 and the erected locking finger 34. The stopper rods 32, 33 engage the inner surface of the side panel 13 to retain the tape guide 30 in the housing 11, and also serve to prevent the tape guide 30 from being tilted with respect to the vertical axis of the tape guide 30 so that the tapes F1, F2 can be unreeled off the respective spools S1, S2 at equal rates.

FIG. 3 shows the manner in which the male and female surface-type fastener tapes F1, F2 are progressively unwound from the respective spools S1, S2 and drawn out of the housing 11 through the tape guide 15 typically by the user who pulls the tapes F1, F2. The tapes F1, F2 as they are unreeled off the spools S1, S2 are twisted 90° in opposite directions so that their surfaces bearing the hooks and loops are brought into face-to-face relation. The tapes F1, F2 are displaced toward each other by the tape guide 15 when they enter the tape guide 15. While the tapes F1, F2 are progressively passed into and through the tape guide 15, the hooks and the loops on the tapes F1, F2 are interengaged to combine or mate the tapes F1, F2 together in a proper relative position within the guide channel 21. The mated tapes F1, F2 are subsequently drawn out of the housing 11 as a combined continuous surface-type fastener F. Therefore, the pair of properly mated tapes F1, F2 can smoothly be pulled manually out of the case 10 for use or sale.

Normally, the terminal ends of male and female surface-type fastener tapes are fixed to their spools by adhesive tapes. Where male and female surface-type fastener tapes are stored in and to be dispensed from the case 10 of the invention, the terminal ends of the tapes should not be bonded or otherwise connected to the spools, so that the entire tapes can smoothly be drawn out of the case 10. This is advantageous because the empty spools S1, S2 can immediately be replaced with new spools after the tapes have been dispensed away.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A case for storing and dispensing a surface-type fastener, comprising:

(a) a housing including a side panel having a slot;

(b) a pair of substantially coaxial spools for supporting male and female surface-type fastener tapes, respectively, thereon, said spools being rotatably disposed in said housing and axially disconnected from said housing; and (c) a tape guide swingably supported in said slot by said panel, said tape guide having a guide channel of a cross-sectional shape complementary to the cross-sectional shape of the male and female surface-type fastener tapes which are mated together.

2. A case according to claim 1, said tape guide having a front end positioned in said slot with a rear end swingable with respect to said housing.

3. A case according to claim 1, said spools being placed side by side within said housing, said housing having an openable and closable cover lying substantially perpendicularly to the axes of said spools.

4. A case according to claim 1, said tape guide having a retainer plate projecting away from said guide channel and a locking finger projecting away from said guide channel, said side panel being sandwiched between said retainer plate and said locking finger.

5. A case according to claim 1, said tape guide having a pair of stopper rods projecting in opposite directions away from said guide channel and a locking finger projecting in one of said directions away from said guide channel, said side panel being sandwiched between one of said stopper rods and said locking finger.

6. A case according to claim 5, said locking finger being resiliently deformable toward said guide channel.

7. A case according to claim 1, each said spool including a hollow shaft having at one of its opposite end a flange, a further flange detachably mounted on the other end of said shaft, and a cap snappingly fitted to the other end of said shaft.

* * * * *